US005480520A

United States Patent [19]

Esslinger

[11] Patent Number: 5,480,520

[45] Date of Patent: Jan. 2, 1996

[54] APPLYING PRESSURE ON THE WEB AT THE WIRE END OF A PAPER MACHINE

[75] Inventor: Klaus Esslinger, Nattheim, Germany

[73] Assignee: J. M. Voith GmbH, Germany

[21] Appl. No.: 181,190

[22] Filed: Jan. 13, 1994

[30] Foreign Application Priority Data

Jan. 18, 1993 [DE] Germany ..... 43 01 103.9

[51] Int. Cl.[6] ..... D21F 1/00

[52] U.S. Cl. ..... 162/301; 162/300; 162/352

[58] Field of Search ..... 162/300, 301, 162/303, 352, 205

[56] References Cited

U.S. PATENT DOCUMENTS

| | | | |
|---|---|---|---|
| 1,875,075 | 8/1932 | Mason . | |
| 3,397,112 | 8/1968 | Highton et al. | 162/318 |
| 3,455,780 | 7/1969 | Hazard, Jr. et al. | 162/301 |
| 4,024,015 | 5/1977 | Kankaanpaa | 162/318 |
| 4,235,667 | 11/1980 | Bergstrom et al. | 162/301 |
| 4,523,978 | 6/1985 | Pullinen | 162/352 |
| 4,708,773 | 11/1987 | Fujiwara et al. | 162/301 |
| 4,714,521 | 12/1987 | Fujiwara | 162/301 |
| 5,167,770 | 12/1992 | Bubik et al. | 162/352 |
| 5,211,814 | 5/1993 | Jaakkola et al. | 162/301 |
| 5,259,929 | 11/1993 | Bubik et al. | 162/301 |

FOREIGN PATENT DOCUMENTS

| | | | |
|---|---|---|---|
| 104910 | 12/1926 | Austria | 162/352 |
| 0496073 | 12/1991 | European Pat. Off. . | |
| 0516601 | 12/1992 | European Pat. Off. . | |
| 1511238 | 3/1966 | Germany . | |
| 4014403 | 11/1991 | Germany . | |
| 3138133 | 9/1983 | United Kingdom | 162/300 |
| 9102842 | 3/1991 | WIPO . | |

*Primary Examiner*—Karen M. Hastings

*Attorney, Agent, or Firm*—Ostrolenk, Faber, Gerb & Soffen

[57] ABSTRACT

The wire end or forming section of a paper making machine is a twin wire section defined by two endless loop wire belts or wires between which fibrous suspension moves through the wire end. A supporting element, either in the form of a rotating cylinder or in the form of a support belt, has the wires passing over it in the twin wire zone. Pressure elements, in the form of strips, rods or even a shoe, are supported to apply pressure on the wire belts and directed toward the moving supporting surface. The pressure elements are placed along the twin wire path so that pressure free regions remain between neighboring pressure elements. The pressure elements are distributed over the entire width of the wire belts.

27 Claims, 7 Drawing Sheets

17
16
3
2
1
F
Ft
Fr
10

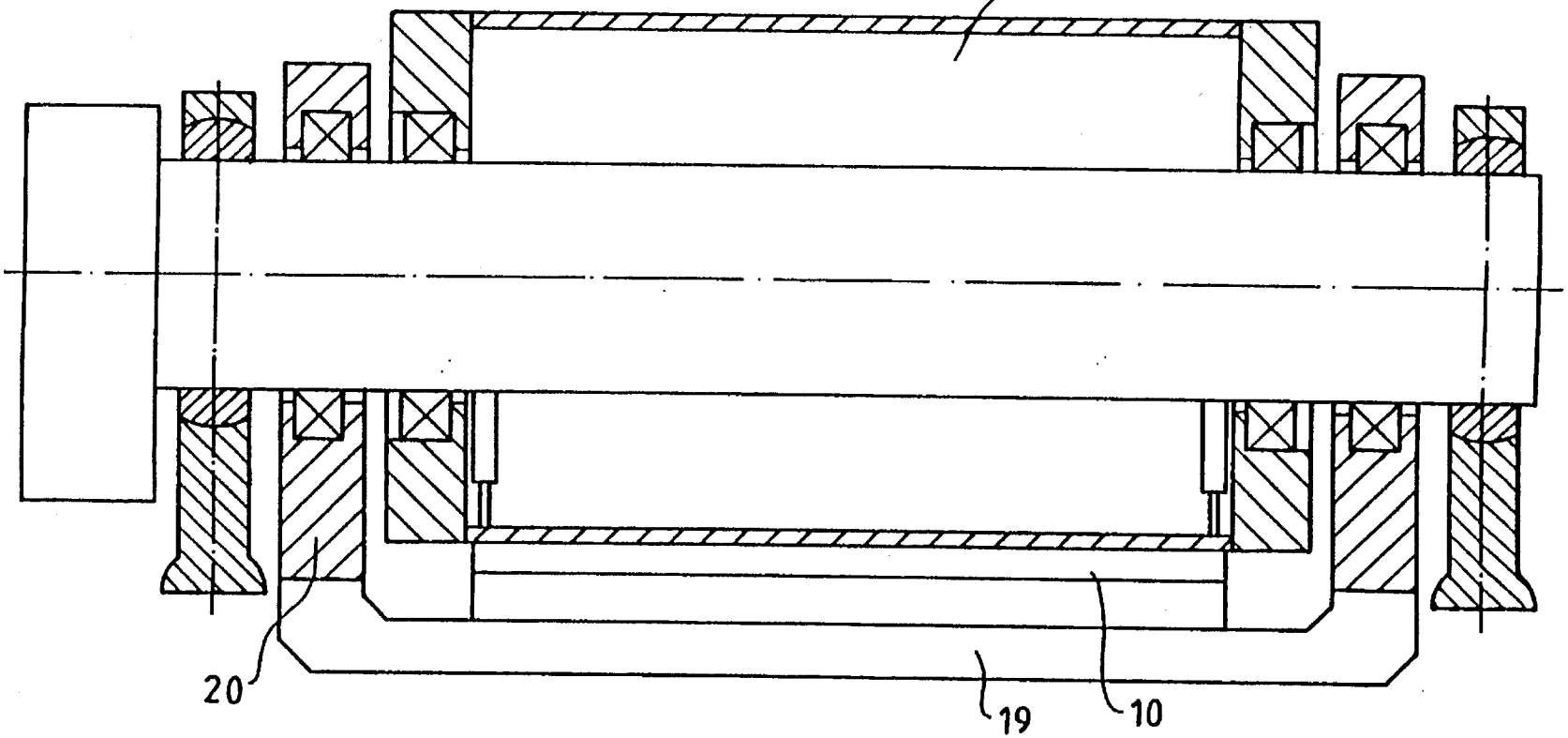
Fig.7.1

APPLYING PRESSURE ON THE WEB AT THE WIRE END OF A PAPER MACHINE

BACKGROUND OF THE INVENTION

The present invention relates to a wire end or forming section of a paper making machine, particularly a twin wire forming section, and more particularly to the application of pressure to the two wires of a twin-wire forming section for aiding fiber suspension quality.

The invention is developed from the twin-wire former disclosed in International Application WO 91/02842. Two endless forming wire belts form a twin-wire zone, which can be subdivided into three sections.

In the first section, the two wires run over a curved supporting surface of a supporting element, which is there preferably a forming cylinder. They there form a wedge shaped entry nip, to which the headbox directly transmits pulp suspension. In the region of the forming cylinder, some of the water in the fiber suspension is removed downward. Some of the water also penetrates upward through the top wire, on account of the tension of the top wire, and that water is removed by means of subatmospheric pressure. The dewatering pressure is in this case the same in the area where the wire belts wrap around the forming cylinder.

In the second section, there are a plurality of compliantly supported strips which bear against the bottom wire. Between each pair of support strips along the bottom wire, there is a respective fixedly supported strip bearing against the top wire.

The compliantly supported strips in the second section direct forces onto the inner surface of the bottom wire, i.e. the surface of the wire inside its endless loop form. The strips produce linear loads, which induce tolerances in the fiber suspension between the two wires on account of the minimal cross-sectional changes when the suspension flows through at a high operating rate. This avoids flocculation.

In the third section, both wire belts run over a further curved supporting surface of a support element. The support element is preferably in the form of a forming shoe having a curved surface.

The combination of already known features in this three section arrangement ensures relatively good paper web quality with respect to two sidedness, look through and uniformity of formation. However, quality requirements in these respects have increased, so that further improvements are desirable. It is intended that the improvements should also be achievable by means of a simpler configuration of supporting elements. A disadvantage of the above known arrangement is caused by the relative movement between the top wire and the rigid strips. The inner surface of the top wire, inside its loop form, is subject to the effects of wear. Also, due to the in line arrangement of the various supporting elements in the individual sections I, II and III, the wire end of the machine has considerable overall length.

EP 0 516 601 A1 publication discloses pressure elements in the form of flexibly designed blades that may be effective on the wire belts in the region of the individual supporting elements for intensifying the dewatering of the suspension, for accomplishing optimum basis weight distribution of the suspension and also for counteracting flocculation in the fiber suspension. The blades are arranged in such a way that their blade bodies lie substantially transverse to the web running direction and bear with part of their surfaces against one of the wire belts and press that belt against the supporting element. In the configurations described, the blades are effective only as pressure elements, not as water skimming elements.

The support elements take various forms, for example, a wire frame with a closed surface or a surface provided with an opening for the purpose of suction intake, or a forming cylinder or an element designed in the form of a strip.

The arrangement of the flexibly configured blades with respect to the wire belt supported by the supporting surface and also the flexibility of the blades are of significance for the magnitude of the pressure impulses which are introduced. In the configurations described, the magnitude of the pressure impulses is changed mechanically by spindles or pneumatically by hoses which bear against the blade body. By changing the cross section, these produce increased bending stress on the blade bodies and consequently produce an increase in the contact pressure of the part of the blade body bearing against the wire belt. The blade arrangement with the associated adjusting mechanism for changing the contact pressures is a relatively complicated structure. Thus, substantially only one installation position of the blades is possible. The magnitude of the contact pressures is dependent on the properties of the blades, and specifically on the flexibility of the blade material. In cases of low contact pressures, high blade flexibility and clotting of the fiber suspension, there is the risk of the blade body oscillating. The contact pressure and consequently the hydraulic pressure in the suspension or the pressure impulse effective in the suspension are also dependent on the blade angle. The effects of wear at the blade cutting edge result, however, in changing of the blade angle. This is found to be a particular problem if there is uneven wearing of the blade cutting edge over the width of the machine.

A further disadvantage of this configuration is that clots, which form from fine fibers which penetrate through the wire mesh during dewatering and which can form upstream and downstream of the blade, enter into a wedge which is formed, by the arrangement of the blade and the supporting surface, between the blade and the supporting surface and damage the wires there.

SUMMARY OF THE INVENTION

The invention is therefore based on the object of further developing the possibilities of intensifying dewatering and improving web quality by preventing flocculation in the fiber suspension in the forming section or wire end of a paper making machine such that the overall length of the wire end of the paper machine is reduced. Further, wear damage to at least one of the wire belts is to be reduced. It is intended to avoid the disadvantages of known configurations.

These objects are achieved by features of the invention. The wire end or forming section of a paper making machine is a twin wire section defined by two endless loop wire belts or wires between which fibrous suspension moves through the wire end. A supporting element, either in the form of a rotating cylinder or in the form of a support belt, has the wires passing over it in the twin wire zone. Pressure elements, in the form of strips, rods or even a shoe, are supported to apply pressure on the wire belts and directed toward the moving supporting surface. The pressure elements are placed along the twin wire path so that pressure free regions remain between neighboring pressure elements. The pressure elements are distributed over the entire width of the wire belts.

The most suitable support element, which is arranged in the twin-wire zone has a support surface against which the pressure elements act. The support surface moves or runs around, i.e. it is a forming cylinder with a rotatable jacket or a belt that moves around belt guide rolls. Use of this movable support surface produces the advantage that the effects of centrifugal force and introduced pressure impulses are added together to improve dewatering. Furthermore, friction on the wire belt is avoided, which contributes to reducing both belt wear and required drive power. However, a support surface is used which is preferably rigid in the direction in which the pressure acts on the wire belts and which cannot yield in that direction.

Using pressure elements to bring pressure to bear induces linear or punctiform loads, or in the case of a concave surface pressing shoe, planar loads, on the wire belt and produces turbulences in the fiber suspension between the wire belts, which contributes to reducing flocculation and improves dewatering.

The pressure elements, which are designed as strips, metering rods or concave pressing shoes, may either extend together or each on its own may extend over the entire wire width. It is also possible for the pressure elements to be mounted such that they can be tilted or turned. Preferably, there are always a plurality of the pressure elements arranged one behind the other along the web running direction and all extending substantially perpendicular to the running direction of the fiber suspension. Furthermore, the pressure elements are preferably able to be pressed compliantly against the inner, or inside the belt loop, surface of the respective wire belt. Their contact pressure is variably adjustable over time and also among the successively arranged pressure elements for each individual pressure element. An arrangement of the pressure elements at an angle to the running direction of the fiber suspension is likewise conceivable.

The pressure elements are preferably arranged such that the forces required for bringing the pressure elements to bear are directed perpendicularly to the wire belt. This offers the advantage that the full contact pressure can be directed as a pressing force onto the wire belts. However, directing the forces applied by the pressure elements at an oblique angle to the support surface is also possible, and then there is a component of force directed toward the wire belts and at the support surface.

The pressure elements are preferably mounted on a supporting frame which is in turn mounted on the machine frame. The supporting frame is swivelable away from the support surface. Where the support surface is on a forming cylinder, the supporting frame is preferably swivelable about the forming cylinder axis and is fastened on the housing of the forming cylinder mounting.

Other objects and features of the invention are explained below with reference to the drawings:

DESCRIPTION OF THE PREFERRED EMBODIMENTS

Figure 1:
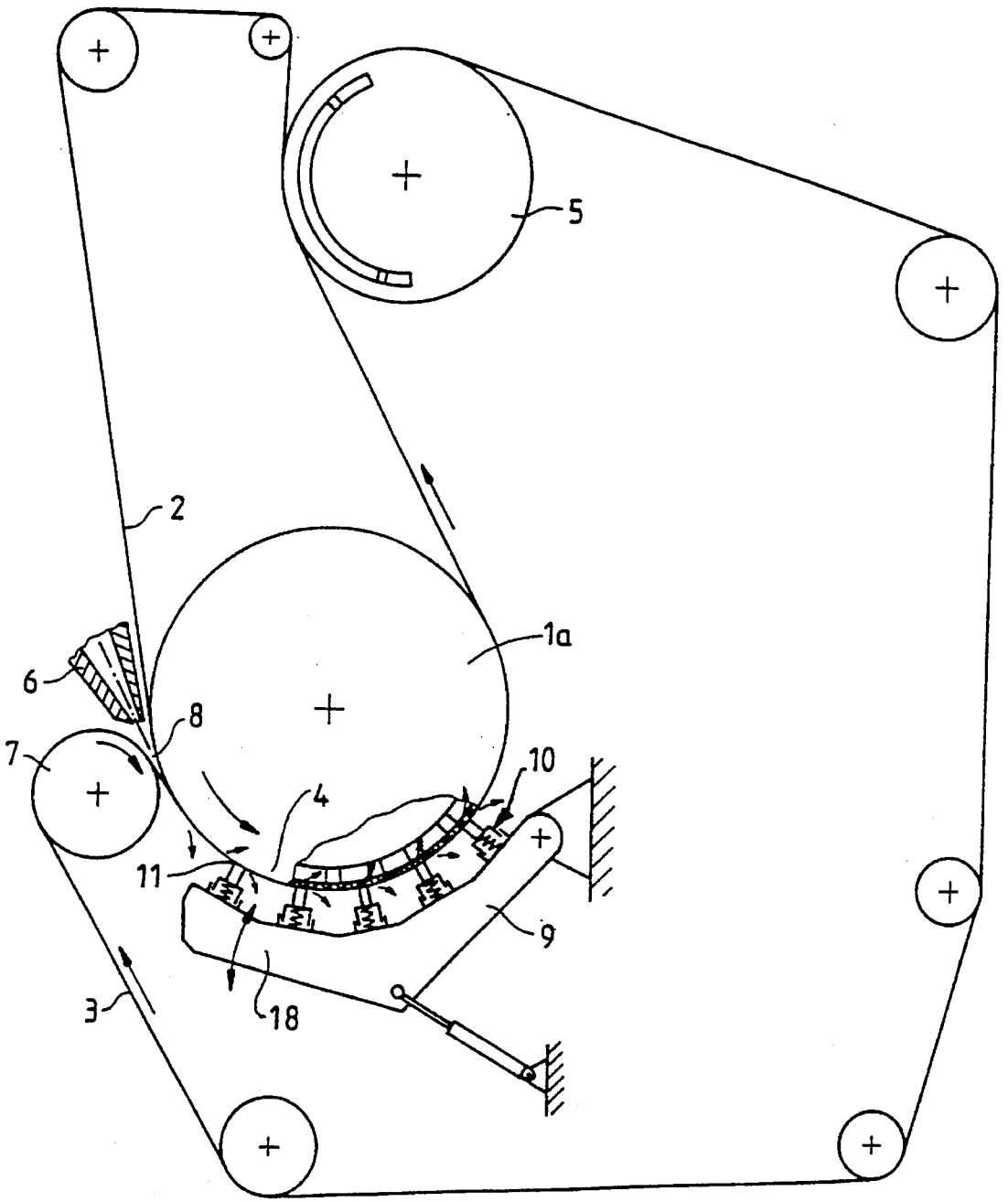
FIG. 1 schematically shows a cutaway portion from a twin wire forming section of a paper making machine.

FIG. 1 illustrates a partially cutaway portion of a schematic end view of a wire end of a twin-wire paper machine. There is a supporting element 1 in the form of a forming cylinder 1*a*. The cylinder jacket may have a closed surface. Alternatively, as represented in FIG. 1, the jacket may be provided with a multiplicity of bores, for example for storing pressed out filtrate or water or for the purpose of suction intake if two sided dewatering is desired. The forming cylinder 1*a* is a central unit that is wrapped by two endless wire belts 2 and 3 around part of its circumference, the area of wrap 4. Along this arc on the circumference of the forming cylinder and over a further section, these two wire belts are guided together and with each other form a twin-wire zone that extends up to a suction roll 5. In the immediate vicinity of the headbox 6, which is upstream of the twin-wire zone, the two wire belts first run together, one passing over a roll 7 and one over a cylinder. In particular, the wire belt 2 passes over the forming cylinder 1*a* while the wire belt 3 passes over a breast roll 7, so that at the beginning of the twin-wire zone, the two wire belts form with each other a wedge shaped entry nip 8 for the fiber suspension from the headbox.

Figure 2:
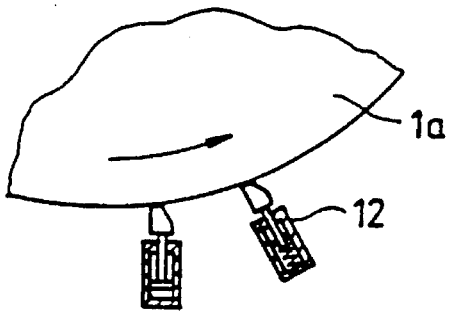
FIGS. 2 to 4 schematically show structurally and functionally advantageous embodiments of the compliantly supported pressure elements in FIG. 1.
Figure 3:
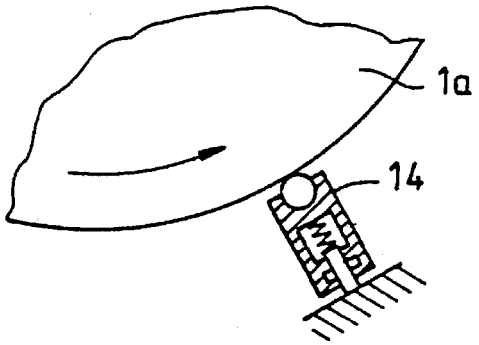
Figure 4:
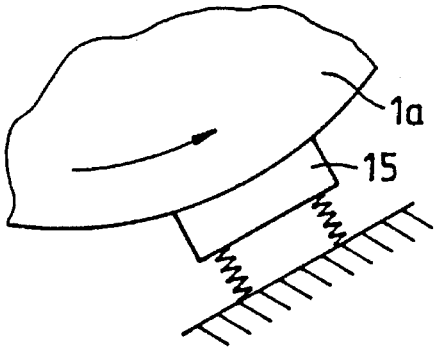

The forming cylinder 1*a* is arranged within the loop of the endless wire belt 2. A device 9 in the illustrated embodiment comprises a supporting frame 18. The compliantly supported pressure elements 10 pass on forces to the belt loop inner surface of the wire belt 3 in the area of its wrap on the forming cylinder 1*a*. The device 9 is arranged within the loop of the endless wire belt 3. The compliantly supported pressure elements 10 are preferably configured as in U.S. Pat. No. 5,078,835. Each element may be designed as a strip 12 that extends along the cylinder 1*a* and across the web (FIG. 2). It may be designed as a roller, and the pressure element is then preferably a metering rod 14 (FIG. 3). A further possibility is to use a pressing shoe 15 as the pressure elements, having a concavely shaped pressing surface against the wire belt (FIG. 4). The compliantly supported pressure elements 10 direct forces, which are produced, for example, by springs or else pneumatically, onto the inner surface (inside the belt loop) of the wire belt 3. Depending on the type and shapes of the pressure elements used, they produce punctiform or linear loads on the wire belt.

As shown in FIGS. 2 and 3, the elements 10 are spaced apart along the path of the wire belts through the twin-wire zone. This provides pressure free regions between the pressure elements. Especially because the pressure elements are spaced apart, turbulences are produced in the fiber suspension between the two wire belts. These introduced pulsations have the effect of preventing flocculation, and more water is extracted on account of the pressure which is brought to bear and the associated changes in the wire tension. The part of the lateral surface of the forming cylinder in the area of wrap and extending over the entire wire width acts as the surface against which pressure is brought to bear.

The magnitude of the forces which are introduced, which produce a particular applied pressure due to the action of the pressure elements 10 on the inner surface of the wire belt 3, is variable and does not have to be kept constant over the entire area of wrap. On account of the shaping and arrangement of the pressure elements, the forces act in such a way that pressure free locations remain in the area in which the wire belts wrap around the forming cylinder. Pressure free regions and the compliant support of the pressure elements are needed to avoid accumulations in the fiber suspension caused by possible agglomerations of the fibers.

Figure 5:
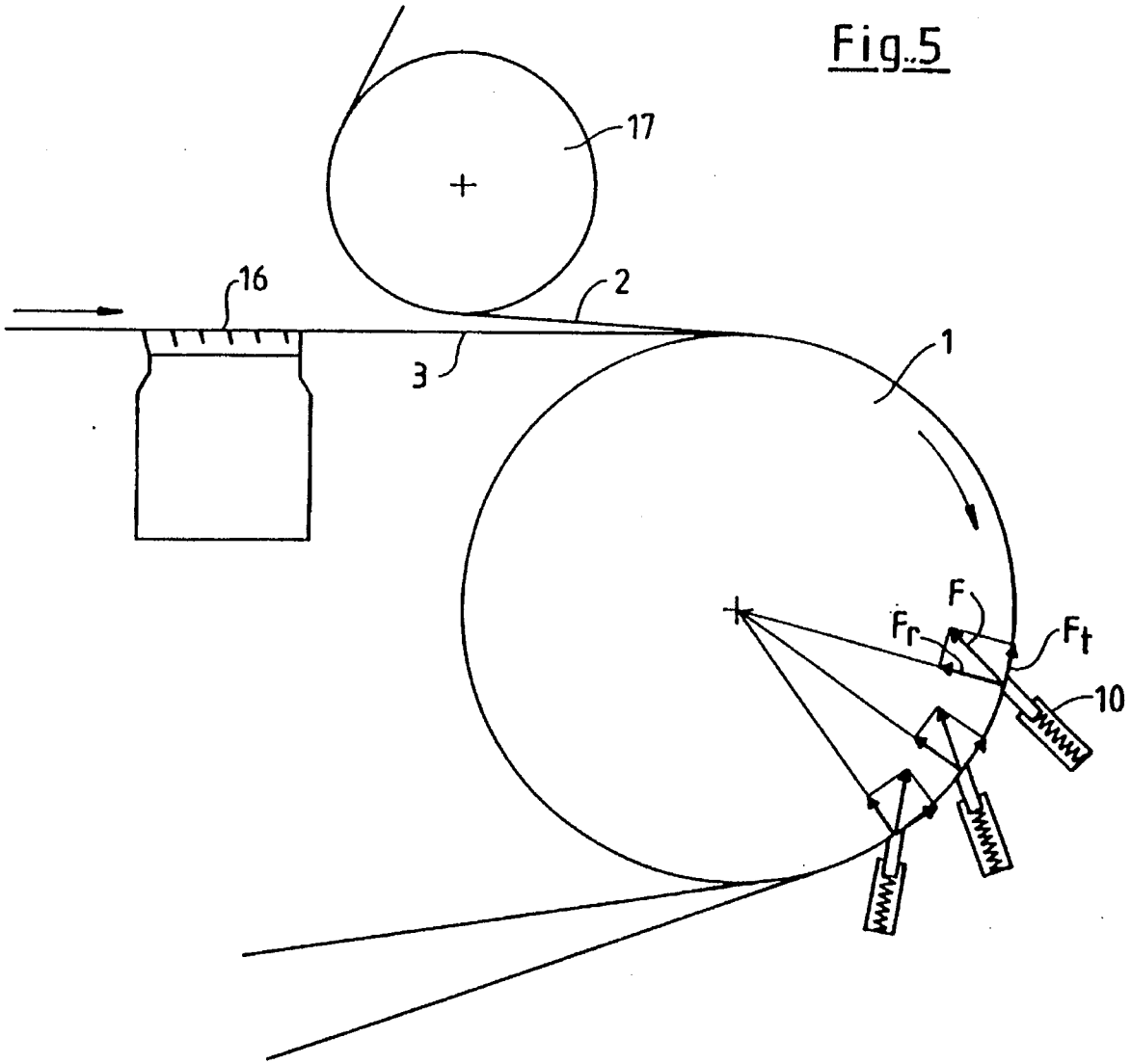
FIGS. 5 and 6 schematically show possible force introduction such that only one component of force acts in the direction of the forming cylinder axis.
Figure 6:
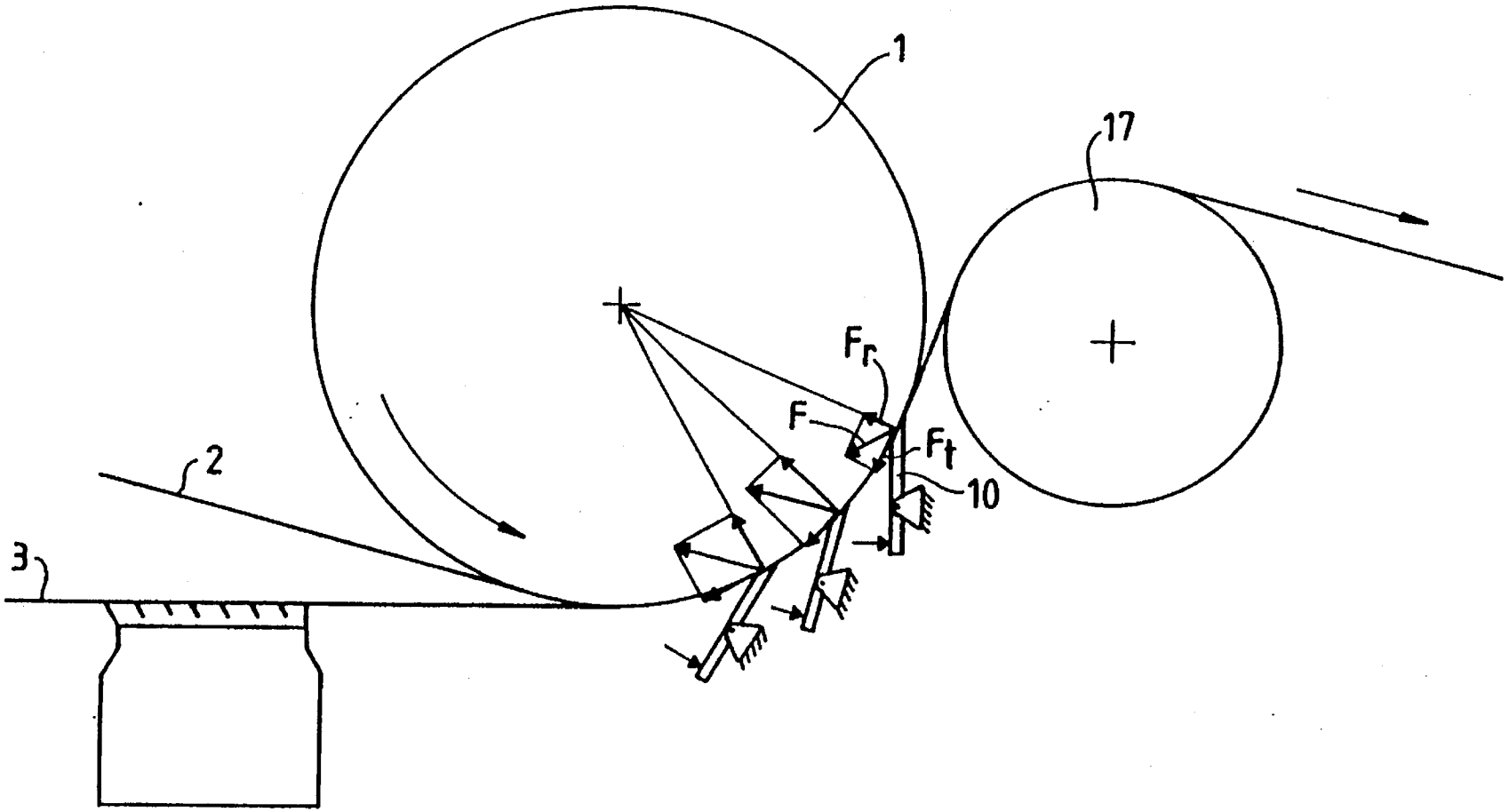

Force is introduced preferably radially with reference to the forming cylinder axis. However, there is also a possibility of force introduction in which only one component of the force acts radially to the forming cylinder axis (FIGS. 5 and 6). FIGS. 5 and 6 also illustrate the possibility of use of the force application with hybrid formers.

In FIG. 5, there is an initial Fourdrinier-type arrangement, in which the fiber suspension is preliminarily dewatered in a conventional way, i.e. preferably by passing the wire belt over strips 16. Then endless wire belt 3 wraps around a supporting element 1, which is here in the form of a solid jacket roll, over part of the surface of the roll. A further endless wire belt 2 is brought together with the wire belt 3 via a roll 17. In the area of wrap and over a further section in which the belts are guided together (which is not shown in more detail here), the two wire belts form a twin-wire zone.

The compliantly supported pressure elements 10, which are pressed against the inner surface of the wire belt 2, apply forces F in a direction such that only one force component $F_r$ acts radially, in the direction of the roll axis, that acts directly as a pressure on the wire belt 2. The tangential force component $F_t$ acts oppositely to the rotation direction of the solid jacket roll and acts as a friction force. The action of the pressure elements 10 produces an increase in the dewatering already induced in the fiber suspension by the circumferentially directed forces occurring upon rotation.

In an analogous design, the hybrid former shown in FIG. 6 includes the endless wire belts 2 and 3 which form a twin-wire zone. In their common area of wrap partly around the supporting element 1, the wires are engaged by compliantly supported pressure elements 10. Those elements 10 are in the form of strips that extend along the cylinder 1 and are mounted such that they can be turned or tilted, i.e. the strips are no longer mounted directly at their radially outer ends but in a radial region of each strip that is intermediate its length. Each strip is connected to a fixed bearing by means of a joint between the radial ends of the strip. Two lever arms are produced. At the end of the lever arm which is not bearing against the wire inner surface, a force is applied which is produced, for example, by springs. The resulting leverage produces a counteracting force of the same magnitude at the end of the other lever arm. The component $F_r$, directed radially to the forming cylinder axis, of the counteracting force F is the pressure acting directly on the wire belt inner surface. The division of the forces and the effect of the individual force components are analogous to the arrangement represented in FIG. 5.

Figure 7:
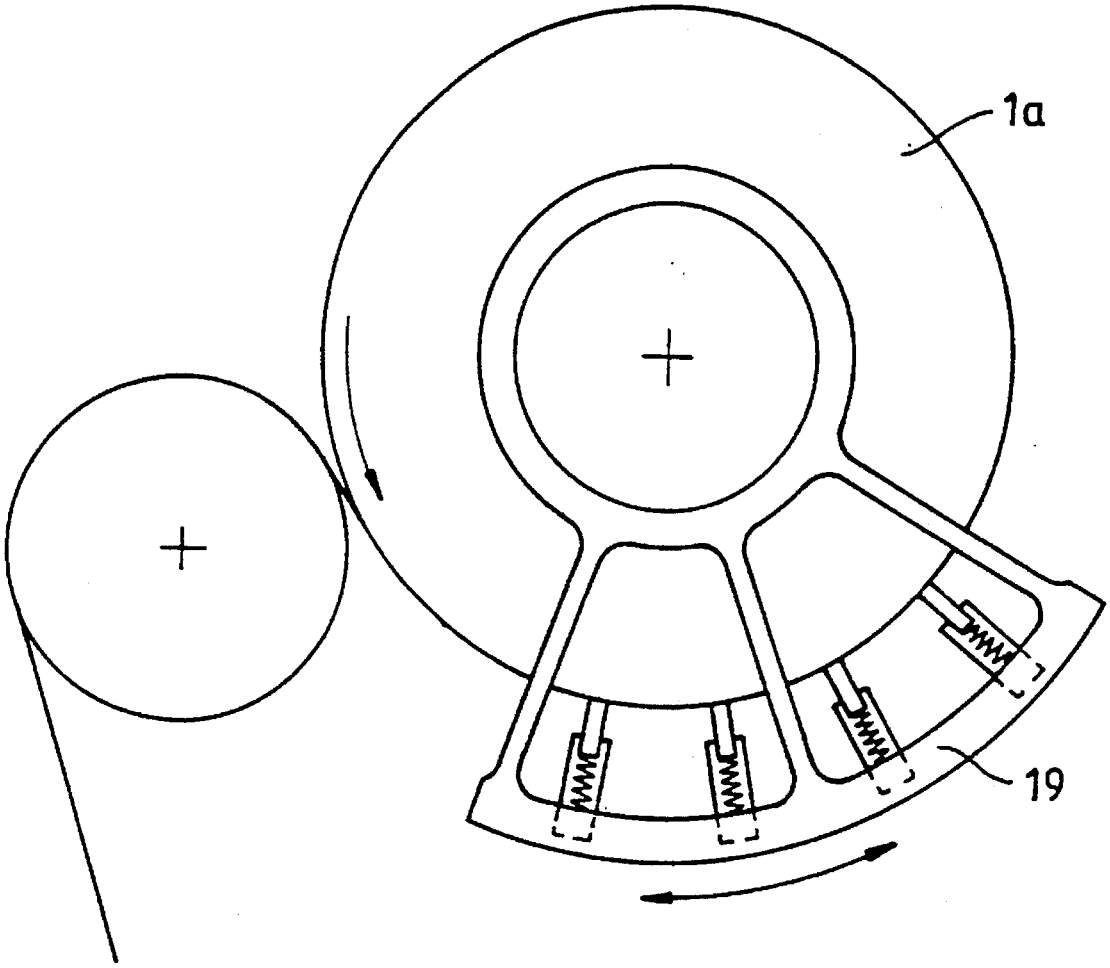
FIGS. 7 and 7.1 schematically show the mounting of the pressure elements on a supporting frame which is fastened on the bearing housing of the forming cylinder axis.

The possible way of mounting the pressure elements shown in FIG. 1 is preferably used. The entire apparatus 9 is located within the loop of the wire belt 3. The pressure elements 10 are mounted on a supporting frame 18, which is in turn supported on the machine frame and can be swiveled away. A further possibility, shown in FIGS. 7 and 7.1 is to mount the pressure elements on a supporting frame 19, which is preferably fastened on the housing 20 of the forming cylinder mounting axis.

The pressing of pressure elements against a wire belt which is supported against a supporting element offers particular advantages, especially for producing multi-ply paper, board and also very thin paper, that is wherever one sided dewatering is desired over a certain section. The supporting element should, however, have a closed supporting surface for the purpose of one sided dewatering.

Figure 8:
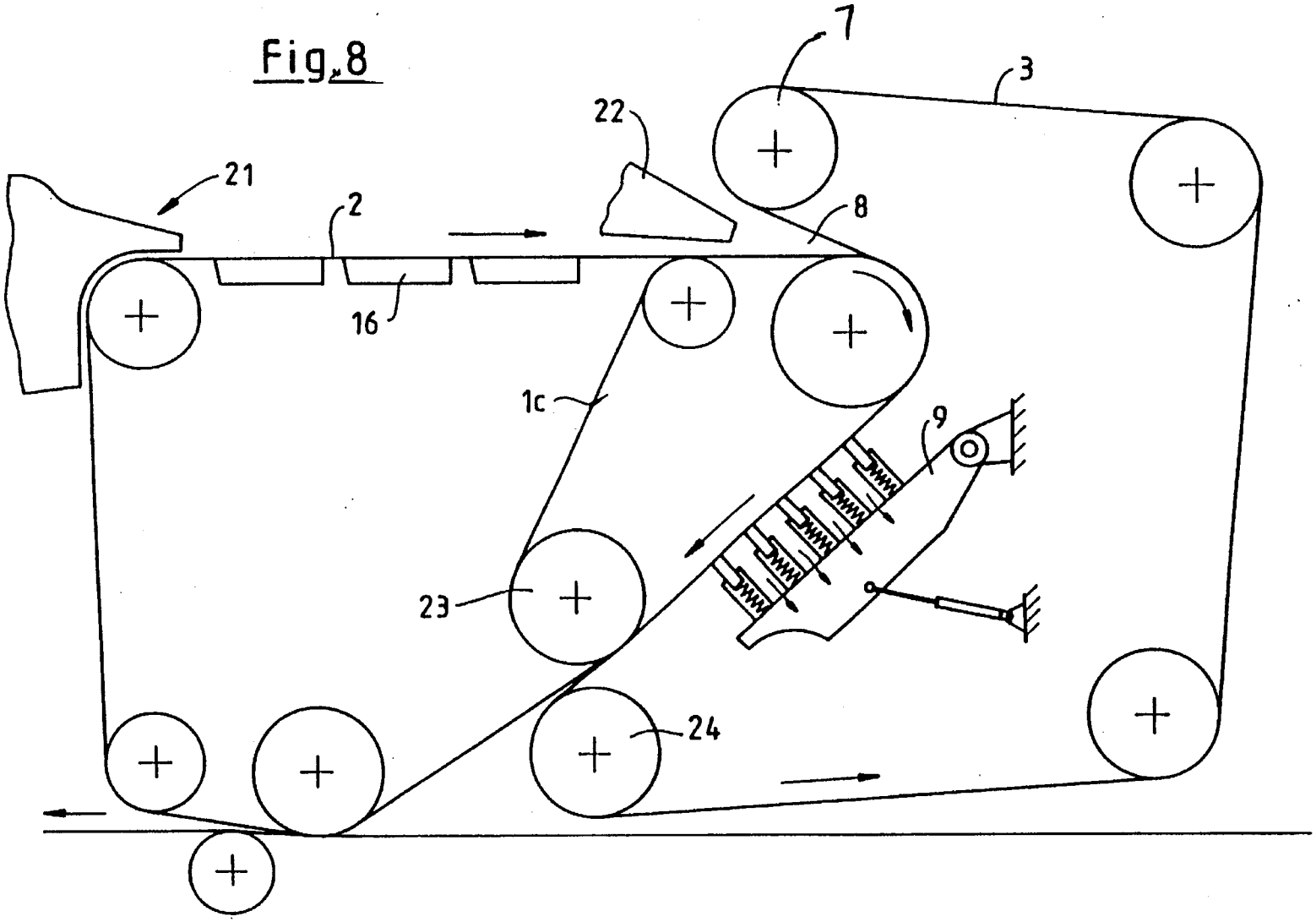
FIG. 8 schematically shows an embodiment with a circulating belt as the supporting element.

FIG. 8 represents an embodiment of the invention as it can be used, for example, in board production. The part of a wire end represented comprises two areas, a Fourdrinier-type zone and a twin-wire zone. For applying the two plies of a fibrous web, two headboxes are provided, a primary headbox 21 and a secondary headbox 22. Following the primary headbox 21, the first ply of fiber suspension is preliminarily dewatered in a conventional way in the Fourdrinier-type area of the wire belt 2, preferably by passing the wire belt over strips 16 and by additional suction removal there. In the vicinity of the secondary headbox 22, the wire belt 2 contacts and then runs along on an endless belt 1*c*, which is guided by a plurality of guide rolls 23. The belt 2 runs together with the wire belt 3, which runs via a roll 7. At the beginning of the twin-wire zone, the two wire belts 2, 3 form with each other a wedge shaped entry nip 8 for the two plies of the fiber suspension. The endless belt 1*c* is arranged within the loop of the wire belt 2 and the belt 1*c* supports the belt 2 on its inner surface in the area of wrap of the wire belt 2 with the belt 1*c*. At the same time, the belt 1*c* supports the outer surface of the wire belt 3 in the area of wrap of the belt 3 with the belt 1*c*. The apparatus 9, which comprises the supporting frame and the pressure elements, is arranged within the loop of the wire belt 3 such that the belt 1*c* acts as the surface against which the pressure elements bear. The dewatering takes place on one side, i.e. in the direction of the pressure elements and away from the supporting surface of the supporting belt 1*c* , and is caused substantially only by the pressure impulses which are introduced. This is because in this region, the wire belts run virtually parallel on account of the guidance of the belt 1*c* over a plurality of guide rolls, which causes a straight path of the belt 1*c* between the individual guide rolls before and after the apparatus 9. The introduced pressure impulses induce turbulences in the fiber suspension and also prevent flocculation of the individual fibers. The two wire belts are separated from each other at the roll 24.

According to the desired dewatering effect and for the avoidance of flocculation, the form taken by the supporting elements/pressure elements arrangement may be varied for the respective application. Lining up a plurality of arrangements of supporting elements and pressure elements is possible.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A wire end of a paper making machine comprising: at least one headbox for supplying a fibrous suspension;

a first endless wire belt, a second endless wire belt, and a guide member guiding the first and second wire belts to move together through a twin wire zone over part of the lengths of the wire belts, the first and second belts being adapted to receive and transport between them the fibrous suspension which is to be dewatered in the twin wire zone;

the first and second wire belts having respective outer surfaces which are the surfaces between which the fiber suspension is received; the first and second wire belts having respective inner surfaces, which are the surfaces away from the fiber suspension and for each belt is the respective surface away from the other wire belt;

a supporting element comprising a forming cylinder located at a stationary position along the twin wire zone and including a rotatable circumferential supporting surface positioned to contact the first wire belt moving through the twin wire zone; at least part of the supporting surface supporting the first wire belt on the inner surface of the first wire belt and supporting the second wire belt on the outer surface of the second wire belt through at least part of the movement of the wire belts through the twin wire zone; the supporting surface being supported at the supporting element for rotating together with the movement of the wire belts; and pressure elements for exerting pressure on the inner surface of the second wire belt in the region through the twin wire zone in which the second wire belt outer surface is supported by the supporting surface; the pressure elements being located and operable to apply pressure to the second wire belt against the supporting surface of the forming cylinder, the pressure elements comprising a plurality of metering rods located so as to engage the wire belts against the rotatable supporting surface of the forming cylinder.

2. The wire end of a paper making machine of claim 1, wherein the guide member is shaped to guide the movement of the wire belts for wrapping the wire belts partially around the rotatable supporting surface of the forming cylinder.

3. The wire end of a paper making machine of claim 1, wherein each of the metering rods extends across the wire belts so as to apply pressure to the second wire belt spaced apart pressure locations along the supporting surface of the forming cylinder for producing pressure free regions along the wire belts where the metering rods are not applying pressure, the metering rods being positioned to define the pressure locations so as to be distributed over the entire width of the second wire belt.

4. The wire end of a paper making machine of claim 1, further comprising a supporting frame adjacent the forming cylinder and on which the pressure elements are mounted such that the pressure elements extend toward the forming cylinder; the supporting frame being swivelably mounted to swivel about the longitudinal axis of rotation of the forming cylinder.

5. The wire end of a paper making machine of claim 4, further comprising a housing for the forming cylinder and in which the forming cylinder is mounted, and the supporting frame being fastened on the forming cylinder housing.

6. The wire end of a paper making machine of claim 1, wherein the pressure elements are oriented to apply pressure perpendicularly to the wire belts passing over the supporting surface.

7. The wire end of a paper making machine of claim 1, further comprising a support for the pressure elements and means mounting the pressure elements to their support so that they can be turned with respect to the pressure element support and with respect to the supporting surface.

8. The wire end of a paper making machine of claim 1, wherein at least some of the pressure elements extend substantially over the width of the second wire belt.

9. The wire end of a paper making machine of claim 1, further comprising respective means connected to individual pressure elements for compliantly pressing the pressure elements toward the supporting surface.

10. The wire end of a paper making machine of claim 9, wherein the means for applying pressure to the pressure elements applies individual variably adjustable pressure to respective pressure elements.

11. The wire end of a paper making machine of claim 1, wherein the at least one headbox includes nozzles for applying a flowable suspension medium against the wire belts and between the wire belts in the twin wire zone.

12. A wire end of a paper making machine comprising:

at least one headbox for supplying a fibrous suspension;

a first endless wire belt, a second endless wire belt, and a guide member guiding the first and second wire belts to move together through a twin wire zone, the first and second belts being located to receive and transport between them the fibrous suspension which is to be dewatered in the twin wire zone;

the first and second wire belts having respective outer surfaces which are the surfaces between which the fiber suspension is received; the first and second wire belts having respective inner surfaces which are the surfaces away from the fiber suspension;

a supporting element comprising a forming cylinder located at a stationary position along the twin wire zone and including a rotatable circumferential supporting surface positioned to contact the first wire belt moving through the twin wire zone, at least part of the supporting surface supporting a portion of the first wire belt on the inner surface of the first wire belt and supporting a portion of the second wire belt on the outer surface of the second wire belt, the supporting surface being rotatably supported for rotating together with the movement of the wire belts; and pressure elements for exerting pressure on the inner surface of the second wire belt in the region of the twin wire zone in which the second wire belt outer surface is supported by the supporting surface, the pressure elements being located and operable to apply pressure to the second wire belt against the supporting surface of the forming cylinder, wherein the pressure elements each comprise a pressing shoe having a concave pressing surface engaging the wire belts against the rotatable supporting surface of the forming cylinder.

13. The wire end of a paper making machine of claim 12, wherein the supporting surface has a shaped profile along the path through the twin wire zone where the pressure elements exert pressure on the wire belts; and the pressing shoe has a pressing surface against the wire belts that is shaped to at least generally conform to the profile of the supporting surface.

14. The wire end of a paper making machine of claim 12, wherein the pressure elements are oriented to apply pressure perpendicularly to the wire belts passing over the supporting surface.

15. The wire end of a paper making machine of claim 12, further comprising a supporting frame adjacent the forming cylinder and on which the pressure elements are mounted such that the pressure elements extend toward the supporting surface; the supporting frame being mounted in the wire end so as to be swivelable to move the pressure elements toward and away from the supporting surface.

16. The wire end of a paper making machine of claim 12, wherein the pressure elements are located so as to apply pressure to the second wire belt at spaced apart pressure locations along the supporting surface of the forming cylinder for producing pressure free regions along the wire belts where the pressure elements are not applying pressure, the pressure elements being positioned to define the pressure locations so as to be distributed over the entire width of the second wire belt.

17. The wire end of a paper making machine of claim 12, wherein the guide member is shaped to guide the movement of the wire belts for wrapping the wire belts partially around the rotatable supporting surface of the forming cylinder.

18. The wire end of a paper making machine of claim 12, further comprising pressing members each connected to one of the pressure elements for compliantly pressing the pressure elements toward the supporting surface.

19. The wire end of a paper making machine of claim 18, wherein the pressing members are operative to apply individual variably adjustable pressure to respective pressure elements.

20. The wire end of a paper making machine of claim 12, wherein the at least one headbox includes nozzles for applying a flowable suspension medium against the wire belts and between the wire belts in the twin wire zone.

21. A wire end in a paper making machine comprising:

two closed-loop wires forming a double-wire section along part of their circumference;

at least one support comprising a forming cylinder having a rotatable circumferential surface forming a supporting surface which is located so that the inside of one of the two closed-loop wires and the outside of the other of the two closed-loop wires rest against at least part of the supporting surface;

pressure elements for applying pressure to the inside of one of the wires where the one of the wires rests against the rotatable circumferential surface of the forming cylinder; and a supporting frame located adjacent the forming cylinder and on which the pressure elements are mounted such that the pressure elements extend toward the forming cylinder, the supporting frame being rotatably mounted to rotate about a longitudinal axis of rotation of the forming cylinder.

22. The wire end of the paper making machine of claim 21, wherein the pressure elements comprise a plurality of strips.

23. The wire end of the paper making machine of claim 21, wherein the pressure elements comprise a plurality of metering rods.

24. The wire end of the paper making machine of claim 21, wherein the pressure elements each comprise a pressing shoe having a concave surface shaped so as to substantially conform to the rotatable circumferential surface of the forming cylinder.

25. The wire end of the paper making machine of claim 21, wherein the pressure elements comprise a plurality of punctiform pressure elements.

26. The wire end of the paper making machine of claim 21, wherein the pressure elements are located so as to apply pressure only to the inside of the one of the wires at spaced apart pressure-application areas along the supporting surface and so that the pressure-application areas are distributed across an entire surface of the one of the wires.

27. The wire end of the paper making machine of claim 21, further comprising a housing for supporting the forming cylinder and in which the forming cylinder is mounted, wherein the supporting frame is secured to the housing.

* * * * *